US012215883B2

(12) United States Patent
Kim et al.

(10) Patent No.: US 12,215,883 B2
(45) Date of Patent: Feb. 4, 2025

(54) CHILLER INCLUDING HEAT TRANSFER TUBE AND METHOD FOR CONTROLLING CHILLER TO DETERMINE DEGREE OF CONTAMINATION OF THE HEAT TRANSFER TUBE

(71) Applicant: LG ELECTRONICS INC., Seoul (KR)

(72) Inventors: Youngjin Kim, Seoul (KR); Joongbeom Lee, Seoul (KR); Solji Ryu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 120 days.

(21) Appl. No.: 17/979,241

(22) Filed: Nov. 2, 2022

(65) Prior Publication Data

US 2024/0068698 A1 Feb. 29, 2024

(30) Foreign Application Priority Data

Aug. 24, 2022 (KR) ..... 10-2022-0106373

(51) Int. Cl.
*F24F 11/83* (2018.01)

(52) U.S. Cl.
CPC ..... *F24F 11/83* (2018.01)

(58) Field of Classification Search
CPC ..... F24F 11/83; F24F 11/49; F25B 49/005; F25B 2339/045; F25B 2339/047; F25B 2500/04; F25B 2500/19; F25B 2500/005; F25B 2700/04; F25B 2700/195; F25B 2700/21161; F25B 39/04; F25B 47/003; F28B 1/02; F28D 7/1607; F28F 27/00; F28F 2265/18
See application file for complete search history.

(56) References Cited

U.S. PATENT DOCUMENTS

| | | | |
|---|---|---|---|
| 5,623,426 A | 4/1997 | Ozawa et al. | |
| 2010/0030385 A1 | 2/2010 | McCormick et al. | |
| 2017/0212606 A1 | 7/2017 | Kingsbury et al. | |
| 2018/0238610 A1 | 8/2018 | Jung et al. | |
| 2019/0293331 A1 | 9/2019 | Ochiai | |
| 2022/0113073 A1 | 4/2022 | Pamaraju | |

FOREIGN PATENT DOCUMENTS

| | | | |
|---|---|---|---|
| CN | 1154824 | 6/2004 | |
| CN | 104697228 A * | 6/2015 | ..... F25B 1/10 |
| CN | 111316053 A * | 6/2020 | |

(Continued)

OTHER PUBLICATIONS

Japanese Office Action dated Mar. 5, 2024.

(Continued)

*Primary Examiner* — Emmanuel E Duke
(74) *Attorney, Agent, or Firm* — KED & ASSOCIATES

(57) ABSTRACT

A chiller including a heat transfer tube and a method for controlling a chiller to determine a degree of contamination of a heat transfer tube are provided. As a degree of contamination of the heat transfer tube may be determined and a notification provided to a user regarding whether to clean the heat transfer tube, the chiller may be managed efficiently and an operation performance of the chiller may be maintained well.

19 Claims, 8 Drawing Sheets

(56) References Cited

FOREIGN PATENT DOCUMENTS

| | | | | | |
|---|---|---|---|---|---|
| JP | 7-151416 | | | 6/1995 | |
| JP | H08338671 | A | * | 12/1996 | |
| JP | 2001-153505 | | | 6/2001 | |
| JP | 2005345046 | A | * | 12/2005 | |
| JP | 4301085 | | | 7/2009 | |
| JP | 4301085 | B2 | * | 7/2009 | |
| JP | 2012-172925 | | | 9/2012 | |
| JP | 2015194301 | A | * | 11/2015 | |
| JP | 2018151116 | A | * | 9/2018 | |
| JP | 6682301 | B2 | * | 4/2020 | |
| KR | 20140048620 | A | * | 4/2014 | ..... F25B 41/315 |
| WO | WO 2017/212606 | | | 12/2017 | |
| WO | WO-2019023267 | A1 | * | 1/2019 | |
| WO | WO-2020186096 | A1 | * | 9/2020 | |

OTHER PUBLICATIONS

European Search Report issued in Application No. 22211889.5 dated Aug. 14, 2023.
Korean Office Action issued in Application No. 10-2022-0106373 dated Oct. 22, 2024.

* cited by examiner

CHILLER INCLUDING HEAT TRANSFER TUBE AND METHOD FOR CONTROLLING CHILLER TO DETERMINE DEGREE OF CONTAMINATION OF THE HEAT TRANSFER TUBE

CROSS-REFERENCE TO RELATED APPLICATION(S)

The present application claims priority under 35 U.S.C. 119 and 35 U.S.C. 365 to Korean Patent Application No. 10-2022-0106373, filed in Korea on Aug. 24, 2022, which is hereby incorporated by reference in its entirety.

BACKGROUND

1. Field

A chiller including a heat transfer tube and a method for controlling a chiller to determine a degree of contamination of a heat transfer tube is disclosed herein.

2. Background

In general, a chiller supplies cold water to a cold water demand destination, and is characterized in that heat exchange is performed between a refrigerant circulating in a refrigeration system and water circulating between the cold water demand destination and a refrigeration system to cool the water. The chiller is designed for a large-capacity facility and may be installed in a large-scale building, for example.

The chiller may include a tower that cools the water. The cooling tower is provided as an open type cooling tower exposed to an external environment, and water stored in the cooling tower may be cooled through heat exchange with outside air. During a cooling process of the water, external foreign matter may be introduced into the cooling tower, and the foreign matter may flow into a heat exchanger of the chiller and be caught in a heat transfer tube inside of the heat exchanger.

The water (hereinafter referred to as "cooling water") is a fluid circulating in the cooling tower and the condenser and requires a large capacity of several tens of tons. It is necessary to continuously supply an amount of cooling water that is sufficient during evaporation of the cooling water. Therefore, an input cost of cooling water is a huge burden from a manufacturer's point of view, and in order to solve this problem, relatively inexpensive industrial water is used as the cooling water.

Therefore, according to a degree of contamination of the industrial water itself, there is a high possibility that foreign matter is caught in the heat transfer tube of the heat exchanger. As such, heat exchange performance of the heat exchanger may be deteriorated due to the foreign matter caught in the heat transfer tube, and reliability of the product may be reduced.

In order to solve this problem, it is essential to clean the heat transfer tube of the heat exchanger. However, it is not easy to check whether the heat transfer tube of the heat exchanger is contaminated enough to require cleaning.

The most reliable method is to check a contamination condition inside of the heat transfer tube with an endoscope, for example; however, for such check, a large amount of cooling water circulating in the cooling tower and heat exchanger must be discarded. Accordingly, there is a need for a method for determining a degree of contamination of the heat exchanger relatively accurately without discarding the cooling water and providing a cleaning notification to the user when it is determined that the heat transfer tube needs to be cleaned.

BRIEF DESCRIPTION OF THE DRAWINGS

Embodiments will be described in detail with reference to the following drawings in which like reference numerals refer to like elements, and wherein.

DETAILED DESCRIPTION

Figure 1:
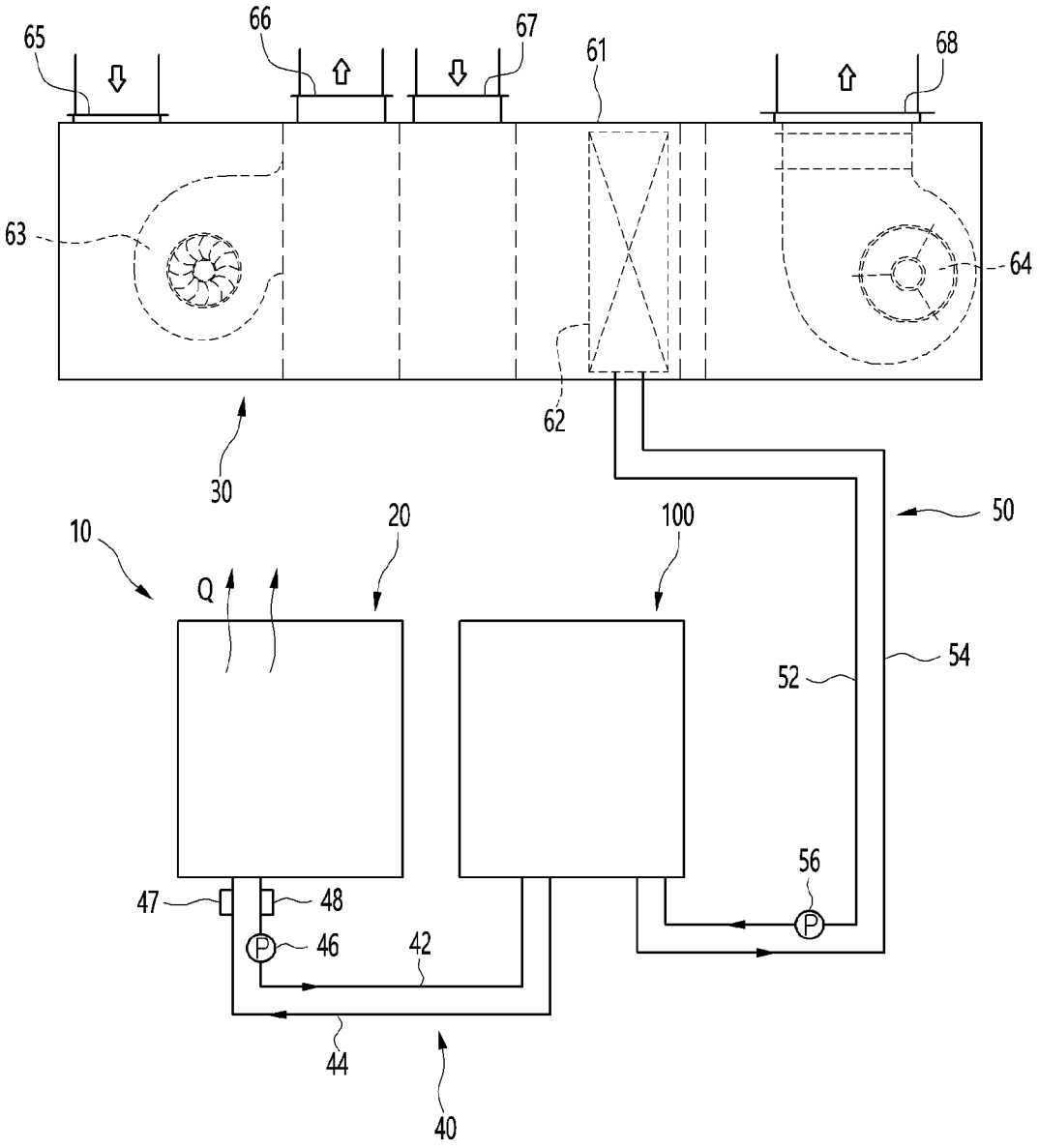
FIG. 1 is a schematic diagram of a chiller according to an embodiment.

Hereinafter, embodiments will be described with reference to exemplary drawings. In adding reference numerals to components of each drawing, it should be noted that the same components are given the same reference numerals as much as possible even though they are indicated on different drawings. In addition, in describing embodiments, if it is determined that description of a related known configuration or function interferes with the understanding of the embodiments, the description thereof has been omitted.

In addition, in describing the components of the embodiment of the present disclosure, terms such as first, second, A, B, (a), and (b) may be used. These terms are only for distinguishing the components from other components, and the essence, order, or sequence of the components are not limited by the terms. When it is described that a component is "connected", "coupled" or "accessed" to another component, the component may be directly connected or accessed to the other component, but it will be understood that another component may also be "connected", "coupled" or "accessed" between each component.

Figure 2:
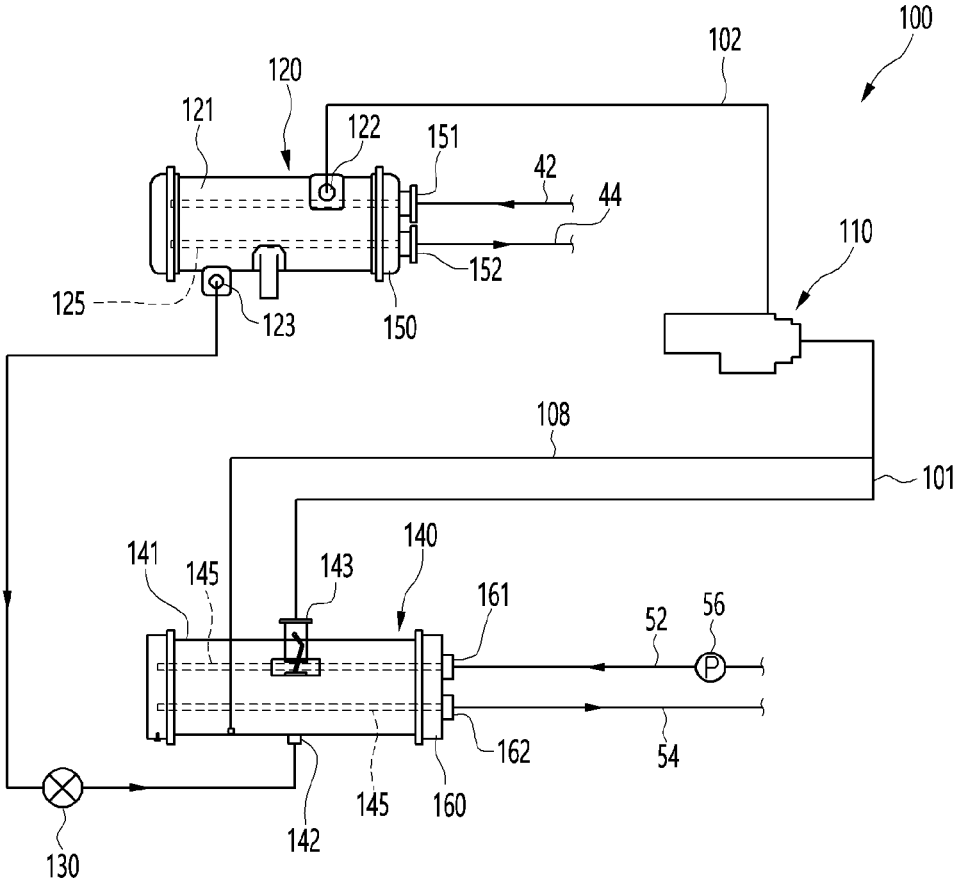
FIG. 2 is a cycle diagram of a chiller according to an embodiment.

FIG. 1 is a schematic diagram of a chiller according to an embodiment. FIG. 2 is a cycle diagram of a chiller according to an embodiment.

Referring to FIGS. 1 and 2, a chiller 10 according to an embodiment may include a cooling module 100 in which a refrigeration cycle is formed and a cooling tower 20 that supplies cold water to the cooling module 100. The cooling tower 20 is exposed to outside air, and cooling water stored in the cooling tower 20 may be cooled by exchanging heat with the outside air. The cooling water may be evaporated by exchanging heat with outside air and may be cooled during an evaporation process.

The cooling tower 20 may be provided with a flow switch that detects a level of the stored cooling water. When the level of the cooling water is lowered due to evaporation, a pump may be operated to replenish the cooling water in the cooling tower 20.

The cold water heat-exchanged with the cooling module 100 may be supplied to a demand destination 30. The demand destination 30 may be understood as a device or space that performs air conditioning using cold water.

A cooling water circulation flow path 40 may be provided between the cooling module 100 and the cooling tower 20. The cooling water circulation flow path 40 may be understood as a pipe that guides the cold water to circulate through the cooling tower 20 and the condenser 120 of the cooling module 100. The cooling water circulation flow path 40 may include a cooling water inlet flow path 42 that guides the cooling water to introduce into the condenser 120, and a cooling water outlet flow path 44 that guides the cooling water heated in the condenser 120 to flow into the cooling tower 20.

A cooling water pump 46 driven for a flow of cooling water may be provided in at least one of the cooling water inlet flow path 42 or the cooling water outlet flow path 44. For example, in FIG. 1, it is illustrated that the cooling water pump 46 is provided in the cooling water inlet flow path 42.

A water outlet temperature sensor 47 that detects a temperature of the cooling water introduced into the cooling tower 20 may be provided in the cooling water outlet flow path 44. In addition, the cooling water inlet flow path 42 may be provided with a water inlet temperature sensor 48 that detects a temperature of the cooling water discharged from the cooling tower 20.

A cold water circulation flow path 50 is provided between the cooling module 100 and the demand destination 30. The cold water circulation flow path 50 may be understood as a pipe that guides the cold water to circulate between the demand destination 30 and the evaporator 140 of the cooling module 100.

The cold water circulation flow path 50 may include a cold water inlet flow path 52 that guides cold water to introduce into the evaporator 120, and cold water outlet flow path 54 that guides the cold water cooled in the evaporator 140 to flow to the demand destination 30.

At least one of the cold water inlet flow path 52 or the cold water outlet flow path 54 may be provided with a cold water pump 56 driven for the flow of cold water. For example, in FIG. 1, it is shown that the cold water pump 56 is provided in the cold water inlet flow path 52.

The demand destination 30 may be a water-cooled air conditioner that heat-exchanges air with cold water. For example, the demand destination 30 may include at least one of an air handling unit (AHU) which mixes indoor air and outdoor air, heat-exchanges the mixed air with cold water, and discharges it into a room; a fan coil unit (FCU) which is installed indoors, and heat-exchanges indoor air with cold water, and then discharges it into a room; and a floor pipe unit buried in a floor of a room.

In FIG. 1, as an example, it is shown that the demand destination 30 is configured as an air handling unit. The air handling unit may include a casing 61, a cold water coil 62 installed inside of the casing 61 and through which cold water passes, and blowers 63 and 64 provided at both sides of the cold water coil 62 and configured to suction indoor air and outdoor air to blow indoor air and outdoor air into the room. The blowers 63 and 64 may include first blower 63 that suctions indoor air and outdoor air into the casing 61, and a second blower 64 that discharges conditioned air outside of the casing 61.

An indoor air suction portion 65, an indoor air discharge portion 66, an outdoor air suction portion 67, and a conditioned air discharge portion 68 may be formed in the casing 61. When the blowers 63 and 64 are driven, some of the air suctioned into the indoor air suction portion 65 from the room is discharged to the indoor air discharge portion 66, and the remainder which is not discharged to the indoor air discharge portion 66 is mixed with the outdoor air suctioned into the outdoor air suction portion 67 to exchange heat with the cold water coil 62. In addition, the mixed air heat-exchanged (cooled) with the cold water coil 62 may be discharged into the room through the conditioning air discharge portion 68.

The cooling module 100 may include a compressor 110 that compresses refrigerant, a condenser 120 into which high-temperature and high-pressure refrigerant compressed in the compressor 110 is introduced, an expansion device 130 that decompresses the refrigerant condensed in the condenser 120, and an evaporator 140 that evaporates the refrigerant decompressed in the expansion device 130. The expansion device 130 may include, for example, an electronic expansion valve (EEV) capable of adjusting an opening degree.

The cooling module 100 may include a suction pipe 101 provided on an inlet side of the compressor 110 and that guides the refrigerant discharged from the evaporator 140 to the compressor 110, and a discharge pipe 102 provided on an outlet side of the compressor 110 and that guides the refrigerant discharged from the compressor 110 to the condenser 120. In addition, an oil return pipe 108 that guides oil existing in the evaporator 140 to a suction side of the compressor 110 may be provided between the evaporator 140 and the compressor 110.

The condenser 120 and the evaporator 140 may be configured as a shell-and-tube heat exchange device to enable heat exchange between the refrigerant and water. The condenser 120 may include a shell 121 that forms an outer appearance, a refrigerant inlet 122 formed on one or a first side of the shell 121 and into which the refrigerant compressed in the compressor 110 is introduced, and a refrigerant outlet 123 formed on the other or a second side of the shell 121 and through which the refrigerant condensed in the condenser 120 is discharged. The shell 121 may be formed approximately in a cylindrical shape.

The condenser 120 may include an inner pipe 125 provided inside of the shell 121 and that guides a flow of cooling water, a cooling water inlet pipe 151 formed at an end portion of the shell 121 and through which the cooling water is introduced into the inner pipe 125, and a cooling water outlet pipe 152 formed at the end portion of the shell 121 to discharge the cooling water from the cooling water pipe 125.

Cooling water flows through the inner pipe 125 to exchange heat with the refrigerant inside of the shell 121 introduced through the refrigerant inlet 122. The inner pipe 125 may be referred to as a "cooling water heat transfer pipe".

The cooling water inlet pipe 151 may be connected to the cooling water inlet flow path 42. The cooling water outlet pipe 152 may be connected to the cooling water outlet flow path 44.

The evaporator 140 may include a shell 141 that forms an outer appearance, a refrigerant inlet 142 formed on one or a first side of the shell 141 and into which the refrigerant expanded in the expansion device 130 is introduced, and a refrigerant outlet 143 formed on the other or a second side of the shell 141 and through which the refrigerant evaporated in the evaporator 140 is discharged. The refrigerant outlet 143 may be connected to the suction pipe 101.

The evaporator 140 may include an inner pipe 145 provided inside of the shell 141 and that guides a flow of cold water, a cold water inlet pipe 161 formed at an end portion of the shell 141 and through which cold water is introduced into the inner pipe 145, and a cold water outlet pipe 162 formed at the end portion of the shell 141 and through which cold water is discharged from the inner pipe 145.

Cold water flows inside of the inner pipe 145 and exchanges heat with the refrigerant inside of the shell 141 introduced through the refrigerant inlet 142. The inner pipe 145 may be referred to as a "cold water heat transfer tube".

The cold water inlet pipe 161 may be connected to the cold water inlet flow path 52. The cold water outlet pipe 162 may be connected to the cold water outlet flow path 54.

A combination of the internal pipe 125 of the condenser 120 and the internal pipe 145 of the evaporator 140 may be referred to as "a water pipe".

Figure 3:
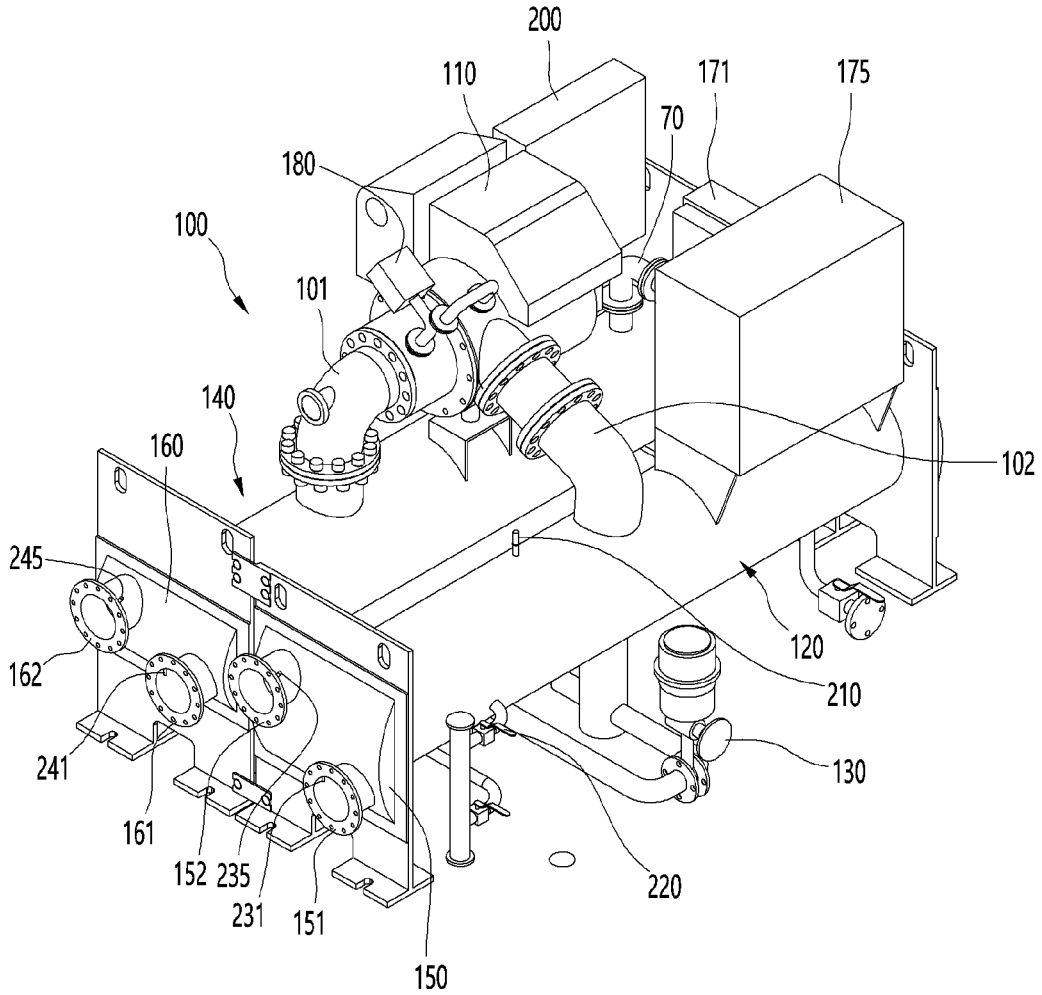
FIG. 3 is a view of a partial configuration of a chiller according to an embodiment.
Figure 4:
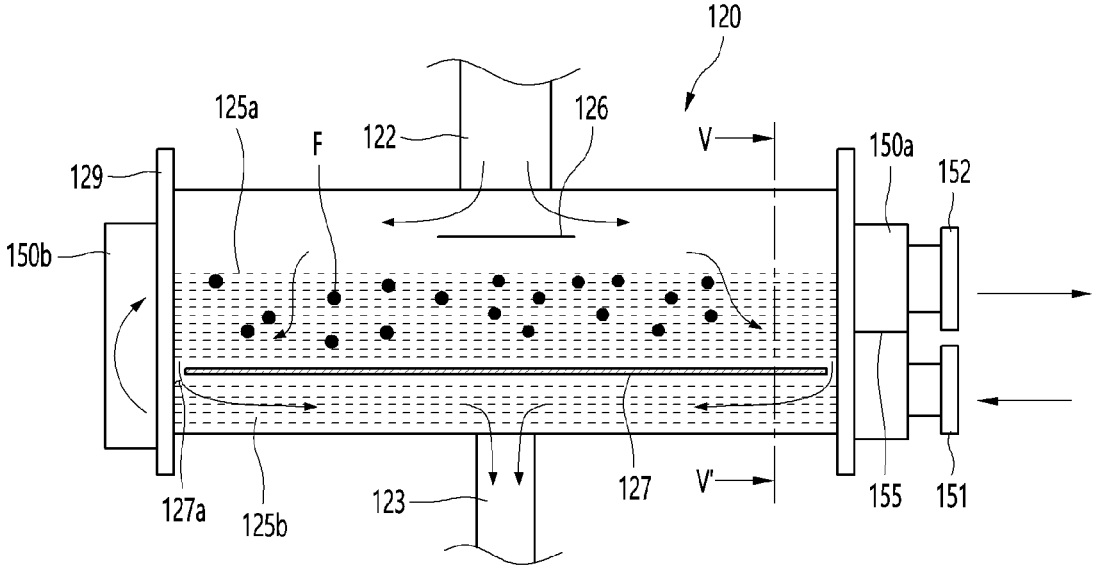
FIG. 4 is a cross-sectional view illustrating an internal configuration of a condenser of the chiller according to an embodiment.

FIG. 3 is a view of a partial configuration of a chiller according to an embodiment. FIG. 4 is a cross-sectional view illustrating an internal configuration of a condenser of the chiller according to the embodiment, and FIG. 5 is a cross-sectional view, taken along line V-V' of FIG. 4.

Figure 5:
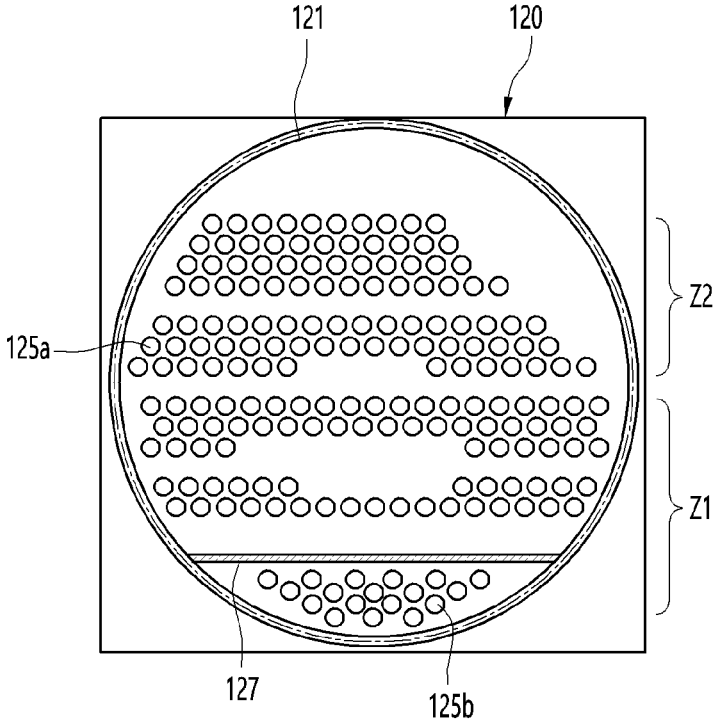
FIG. 5 is a cross-sectional view, taken along line V-V' of FIG. 4.

Referring to FIGS. 3 to 5, the cooling module 100 according to an embodiment may include compressor 110, condenser 120, and evaporator 140. For example, the condenser 120 and the evaporator 140 may be disposed side by side in a lateral or left and right direction, and the compressor 110 may be disposed above the evaporator 140.

The cooling module 100 may include discharge pipe 102 that extends downward from the compressor 110 and is connected to the condenser 120, and suction pipe 101 that extends upward from the evaporator 140 and is connected to the evaporator 140. The cooling module 100 may further include an inverter 175 for power control of the compressor 110. The inverter 175 may be disposed above the condenser 120, for example.

The cooling module 100 may further include a hot gas valve 171 installed in a hot gas pipe that connects the condenser 120 and the evaporator 140. The hot gas pipe may be understood as a pipe that connects an upper end of the condenser 120 and an upper end of the evaporator 140.

The cooling module 100 may further include a capacity control valve 180 for that controls a capacity of the compressor 110. The capacity control valve 180 may be provided in the suction pipe 101 of the compressor 110.

A sensor that detects a state of the refrigerant may be installed in the condenser 120. The sensor may include a condenser level sensor 220 that detects a level of the refrigerant present in the condenser 120.

The condenser level sensor 220 may be installed at a position higher than a lower end portion of the shell 121 of the condenser 120 by a predetermined height. For example, the condenser level sensor 220 may be installed at a position in which it is turned on when the refrigerant fills 70% of an internal capacity of the shell 121.

The sensor may further include a condenser pressure sensor 210 capable of detecting a refrigerant pressure inside of the condenser 120. A pressure value sensed by the condenser pressure sensor 210 may be converted into a saturation temperature and recognized as the refrigerant temperature of the condenser 120. For example, the condenser pressure sensor 210 may be installed on an outer circumferential surface of the shell 121 of the condenser 120.

The cooling module 100 may further include a controller 200 that controls operation of the chiller 10. For example, the controller 200 may be disposed adjacent to one side of the compressor 110.

The hot gas valve 171 may be opened to supply the refrigerant of the condenser 120 to the evaporator 140. The hot gas valve 171 may be installed in a connection pipe 170 that connects an upper end of the condenser 120 and an upper end of the evaporator 140.

When a cooling load required by the chiller 10 is not large, the hot gas valve 171 is opened, and the refrigerant of the high-pressure condenser 120 may flow to the low-pressure evaporator 140 through the open hot gas valve 171. Accordingly, a condensing capacity of the condenser 120 is lowered, and the refrigerant temperature of the condenser passing through the condenser 120 or the water outlet temperature of the cooling water may be maintained at a relatively low temperature.

A cooling water inlet temperature sensor 231 that detects a temperature of the introduced cooling water may be installed in the cooling water inlet pipe 151, which guides introduction of the cooling water into the condenser 120. A cooling water outlet temperature sensor 235 that detects a temperature of the discharged cooling water may be installed in the cooling water outlet pipe 152, which guides discharge of the cooling water from the condenser 120. The cooling water inlet temperature sensor 231 and the cooling water outlet temperature sensor 235 may be installed on outer circumferential surfaces of each of the pipes 151 and 152 and protrude into the respective pipes 151 and 152 to detect the temperature of the cooling water.

A cold water inlet temperature sensor 241 that detects a temperature of the introduced cold water may be installed in the cold water inlet pipe 161 that guides introduction of cold water into the evaporator 140. A cold water outlet temperature sensor 245 that detects a temperature of the discharged cold water may be installed in the cold water outlet pipe 162 that guides discharge of the cold water from the evaporator 140. The cold water inlet temperature sensor 241 and the cold water outlet temperature sensor 245 may be configured to be installed on outer circumferential surface of each pipe 161 and 162 and protrude into an inside of each pipe 161 and 162 to detect the temperature of the cold water.

The cooling module 100 may include water boxes 150 and 160 provided on both sides of the condenser 120 and the evaporator 140. The water boxes 150 and 160 provide a flow space for cooling water or cold water.

The water boxes 150 and 160 may include condenser water box 150 provided on both sides of the condenser 120 to provide a flow space for cooling water. The water boxes 150 and 160 may include evaporator water box 160 provided on both sides of the evaporator 140 to provide a flow space of cold water.

The condenser water box 150 may be provided between the condenser 120 and the cooling water inlet and outlet pipes 151 and 152 of the condenser 120. The cooling water introduced through the cooling water inlet pipe 151 may be introduced into the condenser 120 via the condenser water box 150. The cooling water heat-exchanged with the refrigerant in the condenser 120 may be discharged to the condenser water box 150 and discharged to the outside through the cooling water outlet pipe 152.

The evaporator water box 160 may be provided between the evaporator 140 and the cold water inlet and outlet pipes 161 and 162 of the evaporator 140. The cold water introduced through the cold water inlet pipe 161 may be introduced into the evaporator 140 via the evaporator water box 160. The cold water heat-exchanged with the refrigerant in the evaporator 140 may be discharged to the evaporator water box 160 and discharged to the outside through the cold water outlet pipe 162.

With reference to FIG. 4, an internal configuration and peripheral configuration of the condenser 120 will be described hereinafter.

The condenser 120 may include a cylindrical shell 121 that defines an inner space and lying approximately in a horizontal direction, a plurality of internal pipes 125 provided inside of the shell 121 to guide the flow of cooling water, and condenser water box 150 provided on both sides of the shell 121 and forming a flow space of the cooling water. The plurality of inner pipes 125 extend from one or a first side to the other or a second side of the shell 121 in the horizontal direction and are coupled to shell coupling plate 129. The shell coupling plate 129 may be provided on both sides of the shell 121.

An upper end portion of the shell 121 may be provided with refrigerant inlet 122 to guide introduction of refrigerant. A lower end portion of the shell 121 may be provided with refrigerant outlet 123 to guide discharge of the refrigerant.

The plurality of internal pipes 125 may be configured to form a plurality of rows in the vertical direction. The refrigerant introduced through the refrigerant inlet 122 may be condensed by exchanging heat with an upper pipe of the plurality of internal pipes 125, flow downward, and continuously exchange heat with a lower pipe. The refrigerant condensed after heat exchange with the lower pipe may be discharged outside of the shell 121 through the refrigerant outlet 123.

The plurality of internal pipes 125 may include a first heat transfer pipe 125*a* that forms the upper pipe, and a second heat transfer tube 125*b* that forms the lower pipe. The first heat transfer tube 125*a* may be understood as a condensation heat transfer tube that condenses gaseous refrigerant introduced into the condenser 120, and the second heat transfer tube 125*b* may be understood as a supercooled heat transfer tube which further cools the refrigerant condensed in the first heat transfer tube 125*a*.

A separation plate 127 may be provided between the first heat transfer tube 125*a* and the second heat transfer tube 125*b*. The separation plate 127 may be understood as a collection plate in which the refrigerant heat-exchanged with the first heat transfer tube 125*a* is collected.

A flow hole 127*a* that guides the flow of the refrigerant toward the second heat transfer tube 125*b* may be formed between the separation plate 127 and the shell coupling plate 129. The flow holes 127*a* may be formed on both sides of the separation plate 127.

The refrigerant flowing downward through the flow hole 127*a* flows toward a center of the second heat transfer tube 125*b* and may be discharged to the outside of the shell 121 through the refrigerant outlet 123. The refrigerant outlet 123 may be positioned approximately at a central portion of the shell 121 in a horizontal direction. With this configuration, a heat exchange area between the refrigerant and the first and second heat transfer tubes 125*a* and 125*b* may increase, and heat exchange efficiency may be improved.

A guide plate 126 that guides the refrigerant introduced through the refrigerant inlet 122 to both sides of the first heat transfer tube 125*a* may be provided inside of the shell 121. The guide plate 126 may be disposed adjacent to the refrigerant inlet 122.

The guide plate 126 prevents refrigerant introduced through the refrigerant inlet 122 from directly colliding with the first heat transfer tube 125*a*, reduces a flow rate of the refrigerant. Thus, it is possible to facilitate heat exchange between the refrigerant and the first heat transfer tube 125*a*.

Condenser water box 150 may be coupled to the outside of the shell coupling plate 129. The condenser water box 150 may include first water box 150*a* to which cooling water inlet pipe 151 and cooling water outlet pipe 152 may be coupled.

A partition plate 155 that separates an inner space of the first water box 150*a* may be provided inside of the first water box 150*a*. A first space partitioned by the partition plate 155 forms an inlet space through which the cooling water introduced through the cooling water inlet pipe 151 flows, and a partitioned second space may form an outlet space through which the cooling water to be disposed through the cooling water outlet pipe 152 flows.

The partitioned first space may communicate with a partial pipe of the first heat transfer tube 125*a* and the second heat transfer tube 125*b*. The cooling water in the first space may be introduced into a partial pipe of the first heat transfer tube 125*a* and the second heat transfer tube 125*b* to exchange heat.

The partitioned first space, a partial pipe of the first heat transfer tube 125*a*, and the second heat transfer tube 125*b* may form an inlet region Z1 of the cooling water (refer to FIG. 5). The partitioned second space and the remaining pipes of the first heat transfer pipe 125*a* may form a cooling water outlet region Z2 (refer to FIG. 5).

The condenser water box 150 may include second water box 150*b* provided on an opposite side of the first water box 150*a*. The cooling water introduced into the condenser 120 through the cooling water inflow region Z1 may be introduced into the second water box 150*b*.

The cooling water of the second water box 150*b* may flow through the remaining pipes of the first heat transfer pipe 125*a* to exchange heat. The heat-exchanged cooling water may be introduced into the partitioned second space and may be discharged to the outside of the condenser 120 through the cooling water outlet pipe 152.

Due to the flow of the cooling water in the condenser 120, foreign matter F included in the cooling water may be deposited on the inner pipe 125. In the process of using the cooling module 100 for a long time, if an amount of deposited foreign matter increases, a flow cross-sectional area of the inner pipe 125 may decrease, and heat exchange performance between the refrigerant and the cooling water may be deteriorated by the foreign matter. In order to solve this problem, it is necessary to determine a degree of contamination of the internal pipe 125 by analyzing operation data of the cooling module 100 without directly checking the inside of the internal pipe 125.

Figure 6:
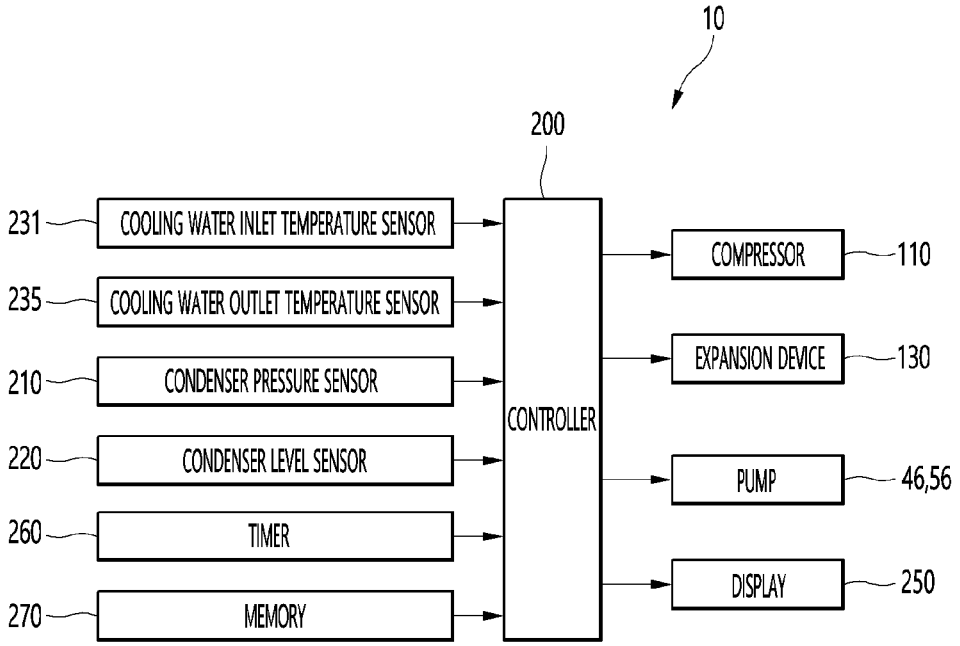
FIG. 6 is a control diagram of a chiller according to an embodiment.
Figure 7:
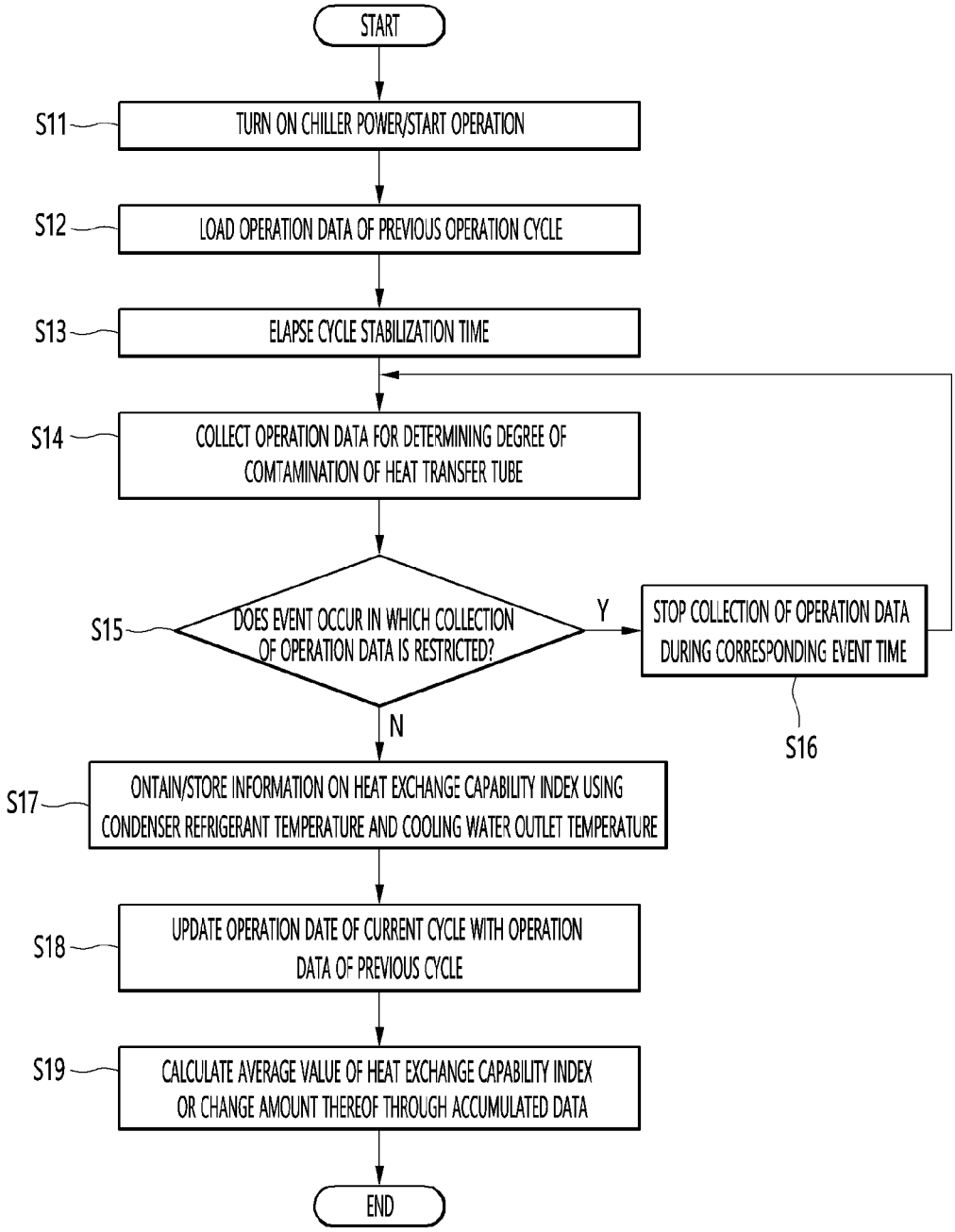
FIGS. 7 and 8 are flowcharts illustrating a method for controlling a chiller according to an embodiment.
Figure 8:
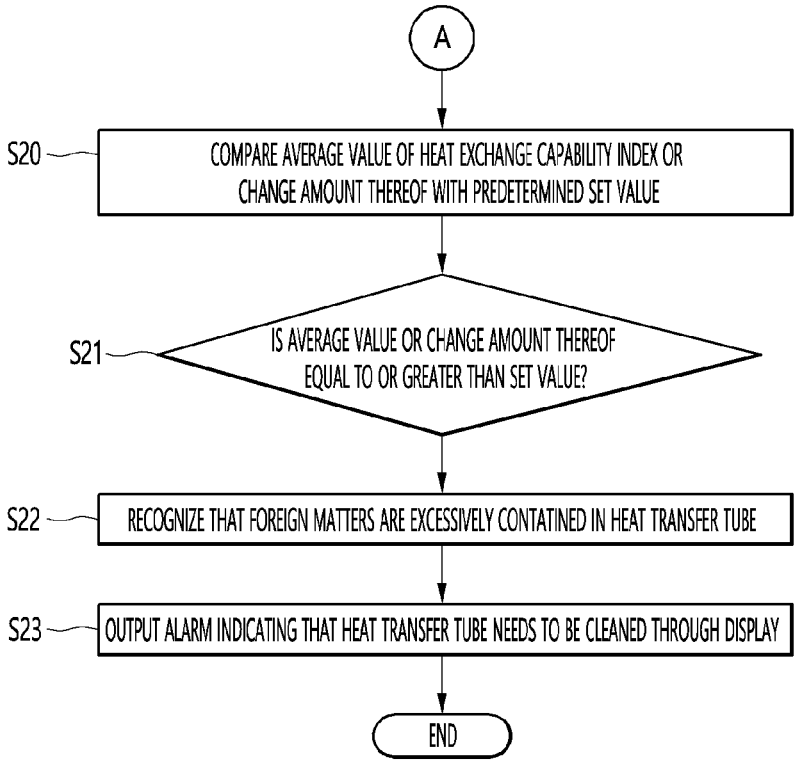

FIG. 6 is a control diagram of a chiller according to an embodiment. FIGS. 7 and 8 are flowcharts illustrating a method for controlling a chiller according to an embodiment.

Referring first to FIG. 6, the chiller 10 according to an embodiment may include a plurality of sensors capable of checking information regarding operation of the chiller. The plurality of sensors may include cooling water inlet temperature sensor 231 that detects the temperature of the cooling water introduced into the condenser 120, and cooling water outlet temperature sensor 235 that detects the temperature of the cooling water discharged from the condenser 120. The plurality of sensors may further include condenser pressure sensor 210 that detects the refrigerant pressure inside of the condenser 120, and condenser level sensor 220 that detects a level of the refrigerant stored in the condenser 120.

The chiller 10 may further include a timer 260 that determines an operation time of the chiller 10. The timer 260 may calculate a time period having elapsed after the chiller 10 is turned on, a time having elapsed after detecting a specific value in the plurality of sensors, or a time period having elapsed since start of operation of the compressor 110, the expansion device 130, and the pumps 46 and 56.

The chiller 10 may further include a memory 270 that stores information about the operation of the chiller 10. For example, the chiller 10 may operate according to a preset or predetermined cycle, and operation data detected in each cycle may be updated in the memory 270.

The chiller 10 may further include the compressor 110, the expansion device 130, and the controller 200 that controls driving of the pumps 46 and 56, based on the information detected by the plurality of sensors 231,235, 210, and 220, the time information accumulated by the timer 260, or the information stored in the memory 270. The chiller 10 may further include a display 250 that displays information on the degree of contamination to the user when it is determined that the degree of contamination due to foreign matter in the internal pipe 125 of the condenser 120 is equal to or greater than a set or predetermined degree of contamination, or notifying the need for cleaning of the internal pipe 125.

Hereinafter, a method for controlling a chiller for determining a degree of contamination of an internal pipe of a condenser will be described with reference to FIGS. 7 and 8.

When the power of the chiller 10 is turned on and operation thereof starts (S11), the controller 200 may load operation information or data from a previous operation cycle (S12). For example, the operation cycle of the chiller 10 may be reset based on a specific time (12 am) with respect to one day. In addition, when the power of the chiller 10 is turned off and then turned on again, the operation cycle of the chiller may be reset.

The operation information may include information on an index for determining a heat exchange capability of the heat exchangers 120 and 140 (hereinafter, "heat exchange index information"). The heat exchange index information serves as a criterion for determining the heat exchange capability between the refrigerant and water and may be determined based on a temperature difference between the water and the refrigerant.

The heat exchange index information of the evaporator 140 of the heat exchangers 120 and 140 may be determined based on a difference value between the cold water outlet temperature and the evaporator refrigerant temperature. Due to characteristics of the cold water circulating in the evaporator 140 along the closed circuit, the possibility of contamination by foreign matter in the internal pipe of the evaporator 140 is low.

The heat exchange index information of the condenser 120 of the heat exchangers 120 and 140 may be determined based on a difference between the refrigerant temperature of the condenser 120 and the cooling water outlet temperature. For example, the heat exchange index information of the condenser 120 may be determined as a value of (refrigerant temperature of condenser-cooling water outlet temperature).

In the condenser 120, due to characteristics of the cooling water circulating in the cooling tower 20 exposed to the outside air, there is a high possibility that contamination by foreign matter occurs in the internal pipe of the condenser 120.

The refrigerant temperature of the condenser may be calculated by converting the pressure value detected by the condenser pressure sensor 210 into a saturation temperature. The cooling water outlet temperature may be understood as a temperature value detected through the cooling water outlet temperature sensor 235.

The refrigerant temperature of the condenser is a factor that varies according to a state of the operation cycle, and artificial adjustment may not be possible. Accordingly, the heat exchange index information of the condenser 120 may be determined according to a change in the cooling water outlet temperature.

It can be understood that as the heat exchange index value of the condenser 120 increases, the heat exchange capability between the refrigerant and the cooling water relatively decreases, and as the heat exchange index value decrease, the heat exchange capability between the refrigerant and the cooling water increases relatively. Based on the phenomenon that the cooling water cools the refrigerant, it may be understood that the heat exchange capability increases as the difference value between the refrigerant temperature and the cooling water temperature decreases.

After the chiller 10 is operated, it may wait for a stabilization time of the cycle to elapse. After the chiller 10 is turned on and starts to operate, it is necessary to wait a set or predetermined time in order to form a pressure/temperature distribution of a required cycle. For example, the set time may be determined within a range of 5 to 10 minutes after the chiller 10 is turned on. This is because it is difficult for the heat exchange index value of the condenser detected before the set time has elapsed to reflect an exact state of the operation cycle. Of course, if the chiller 10 is continuously driven (normally driven) from the previous cycle to the current cycle, the process of waiting until the lapse of this stabilization time may not be necessary (S13).

When the stabilization time of the cycle has elapsed, operation data for determining the degree of contamination of the internal pipe of the condenser 120, that is, the first and second heat transfer pipes 125*a* and 125*b* may be collected. However, the operation data may indicate an abnormal value due to various causes based on a cycle state or an operation mode. Therefore, it is necessary to remove these abnormal values as error messages.

To this end, it may be recognized whether an event in which the collection of operation data is restricted has occurred (S15). An example of an event that stops the collection of operation data is as follows.

The first event is whether the value detected by the condenser level sensor 220 is equal to or greater than a set or predetermined value. For example, the set value may be understood as a value detected by the sensor 220 when the refrigerant fills 70% of the internal capacity of the shell 121.

When the value detected by the condenser level sensor 220 is equal to or greater than the set value, the collection of operation data is stopped. If the value detected by the condenser level sensor 220 is equal to or greater than the set value, it corresponds to the case that the refrigerant level stored in the condenser 120 is too high, and in this case, it may be relatively difficult to condense the refrigerant in the condenser 120.

In this state, the heat exchange index value of the condenser 120 becomes too high, and when the heat exchange index value of the condenser is used as information for determining the degree of contamination of the heat transfer tube of the condenser, the determination regarding the degree of contamination of the heat transfer tube of the condenser 120 may not be accurate. In other words, even if the degree of contamination of the heat transfer tube is not large, an error of determining that the actual degree of contamination is large occurs.

The second event is whether the heat exchange index value of the condenser is equal to or less than a set or predetermined value. For example, the set value may be determined as a value within the range of 0.5 to 0.6.

Although the lower heat exchange index value of the condenser means that the heat exchange performance of the condenser is higher, when the index value is too low, it can be understood that some cause deviating from a normal range of the cycle occurs. For example, the cause may be a malfunction or abnormal operation of a sensor or a pump. When the heat exchange index value of the condenser is equal to or less than the set value, the collection of operation data is stopped.

A third event is a case where the hot gas valve 171 is turned on and opened. When the hot gas valve 171 is turned on and opened, the collection of operation data may be stopped.

When the cooling load required by the chiller 10 is not large, the hot gas valve 171 is opened, and the refrigerant of the high-pressure condenser 120 may flow to the low-pressure evaporator 140 through the open hot gas valve 171. Accordingly, the condensing capacity of the condenser 120 is lowered, and the refrigerant temperature of the condenser or the water outlet temperature of the cooling water passing through the condenser 120 may be maintained at a relatively low temperature.

As described above, in the operation mode in which the hot gas valve 171 is opened, the temperature and pressure range of a general cycle may deviate, and thus, it may be limited to accurately determine the degree of contamination of the condenser heat transfer tube.

The fourth event is a case where the difference value between the water inlet temperature and the water outlet temperature of the condenser 120 is equal to or greater than the set value. When the difference value between the water inlet temperature and the water outlet temperature of the condenser 120 is equal to or greater than the set value, the collection of operation data may be stopped.

When the difference value between the water inlet temperature and the water outlet temperature of the condenser 120 is equal to or greater than the set value, it may be understood that some cause deviating from the normal operating range of the cycle occurs. For example, the cause may be a malfunction or abnormal operation of a sensor or a pump.

When any one of the first to fourth events occurs, the collection of operation data may be stopped for a time during which the corresponding event is maintained (S16). On the other hand, if such an event does not occur, information on the heat exchange capability index for determining the degree of contamination of the condenser heat transfer tube may be acquired and stored in the memory 270. In other words, the heat exchange capability index value of the condenser may be recognized by using the difference value between the refrigerant temperature of the condenser and the water outlet temperature of the cooling water (S17).

The index value of the heat exchange capability of the condenser may be calculated in real time or calculated at a specific time point (for example, every hour on the hour) and stored in the memory 270 while the current cycle is maintained. Through this process, the operation data of the current cycle may be updated in the memory 270 by accumulating to the operation data of the previous cycle (S18).

Through the data accumulated in this way, the average value of the heat exchange capability index value of the condenser 120 or the change amount thereof may be calculated (S19). That is, the controller 200 may calculate an average value of operation data collected for a plurality of operation cycles. For example, the average value may be an average value for each operation cycle or may be an average value obtained by integrating two or more operation cycles.

In order to implement simple control logic, for example, the controller may calculate an average value of a plurality of operation cycles corresponding to one month. The controller 200 may calculate a change amount of the calculated average value. For example, the controller may calculate the change amount thereof, based on a first average value of operation data corresponding to the first month, a second average value of operation data corresponding to the next one month, and a third average value of operation data corresponding to one month thereafter. For example, the calculation of the average value and the change amount of the average value may be performed over a period of 6 to 12 months.

The controller 200 may recognize the degree of contamination of the heat transfer tube of the condenser based on the average value or a change amount of the average value. In other words, the average value or the change amount of the average value and a set or predetermined value may be compared with each other (S20).

For example, when the number of times that the average value is recognized as equal to or greater than the first set value is equal to or greater than the set number, it may be recognized that foreign matter is excessively contained in the heat transfer tube of the condenser. For example, the first set value may be 3 degrees, and the set number of times may be three or more.

As another example, when it is recognized that the change amount for each cycle of the average value is equal to or greater than the second set value, the controller 200 may recognize that foreign matter is excessively contained in the heat transfer tube of the condenser. For example, the second set value may be 2 degrees (S21, S22).

When the controller 200 recognizes that the heat transfer tube of the condenser contains excessive foreign matter, the controller may display information on the degree of contamination of the heat transfer tube through the display 250 or output an alarm indicating that the heat transfer tube needs to be cleaned (S23).

According to this control method, it is possible to accurately analyze the operation data indicating that contamination has occurred in the heat transfer tube of the condenser during operation of the chiller 10, and based on the analysis result, the user may be provided with information on the degree of contamination or a notification of the need for cleaning the heat transfer tube, and thus, user convenience may increase and management efficiency of the system may increase.

Embodiments disclosed herein have been proposed to solve above-described problems, and thus, embodiments disclosed herein provide a chiller that determines a degree of contamination of a heat transfer tube and provides a notification regarding whether to clean the heat transfer tube.

Embodiments disclosed herein provide a chiller capable of determining a degree of contamination by analyzing operation data of the chiller without having a separate component for determining the degree of contamination of the heat transfer tube. Embodiments disclosed herein further provide a chiller equipped with operation logic capable of recognizing a detection value of an existing sensor for a cycle operation of the chiller, processing the recognized data, and calculating a heat exchanger performance factor. Embodiments disclosed herein furthermore provide a chiller having operation logic for selectively extracting specific data of a plurality of operation data recognized during operation of the chiller that may be used to determine the degree of contamination of a heat transfer tube.

In order to select the specific data, the operation data may be extracted after waiting a time for which the cycle operation of the chiller is stabilized. Further, operation data recognized when the value of the condenser level sensor provided in the condenser falls within a specific range may be extracted. Furthermore, operation data recognized when the difference value between the condenser refrigerant temperature and the cooling water outlet temperature falls within a set range may be extracted.

In order to select the specific data, operation data recognized when the hot gas valve provided in the chiller is in an off state may be extracted. Also, operation data recognized when the difference value between the cooling water outlet temperature and the cooling water inlet temperature falls within a set range may be extracted.

Embodiments disclosed herein provide a chiller capable of determining a trend of an increase in degree of contamination by accumulating and storing operation data according to the operation cycle of the chiller and processing the stored operation data, in consideration of foreign matter in a heat transfer tube that accumulates gradually over a long time. In relation to the operation cycle, a new operation cycle may be started when the chiller is turned on after being turned off. Alternatively, if the chiller is still on and operating for one day or more, a new operation cycle may be started when a certain point of the day has elapsed.

Embodiments disclosed herein may include a condenser having a heat transfer tube through which cooling water flows and may include a sensor that detects a refrigerant temperature of the condenser and a temperature of the cooling water in order to recognize the degree of contamination of the heat transfer tube. The sensor may include a condenser pressure sensor that detects a pressure of the refrigerant passing through the condenser. A saturation temperature may be calculated from the pressure detected by the condenser pressure sensor, and the calculated saturation temperature may be recognized as the refrigerant temperature of the condenser. The sensor may include a cooling water outlet temperature sensor that detects a water outlet temperature of the cooling water discharged from the condenser.

Embodiments disclosed herein may include a controller capable of recognizing the degree of contamination of the heat transfer tube based on a temperature difference value between the refrigerant temperature of the condenser and the cooling water. The temperature difference value may constitute a factor representing the heat exchange performance of the condenser.

The controller may selectively collect operation data according to an operation state of the chiller during a period in which the chiller is operated. The controller may collect data detected by the sensor and determine the degree of contamination of the heat transfer tube based on the collected data after a time elapses for the cycle to be stabilized after the chiller is turned on. For example, the time for which the cycle is stabilized may be a time value determined in the range of 5 to 10 minutes.

The controller may recognize a value of a condenser level sensor provided in the condenser and selectively collect operation data based on the recognized refrigerant level of the condenser. For example, operation data may be collected when the refrigerant level of the condenser is equal to or less than a set level, and collection of operation data may be stopped when the refrigerant level of the condenser is equal to or greater than the set level.

The controller may recognize a difference value between the condenser refrigerant temperature and the cooling water outlet temperature and selectively collect operation data based on the difference value. For example, when the difference value is equal to or greater than a set value, the operation data is collected, and when the difference value is equal to or less than a set value, the collection of the operation data may be stopped.

The controller may recognize whether the hot gas valve provided in the chiller is turned on and opened or turned off and closed, and selectively collect operation data based on the recognition result. For example, operation data may be collected when the hot gas valve is turned off and closed, and the collection of operation data may be stopped when the hot gas valve is turned on and opened.

The controller may recognize a difference value between the cooling water outlet temperature and the cooling water inlet temperature and selectively collect operation data based on the difference value. For example, when the difference value is within a set value, operation data may be collected, and when the difference value is greater than the set value, the collection of operation data may be stopped.

The controller may collect and update operation data for each operation cycle of the chiller and process the collected operation data to determine a trend of an increase in the degree of contamination. The operation data may be data regarding a difference value between the refrigerant temperature of the condenser and the water outlet temperature of the cooling water. For example, the operation cycle may be divided based on a time point at which the chiller is turned on after being turned off, or based on a specific time point of the day if the operation continues for more than one day.

The controller may calculate an average value of the operation data collected for a plurality of driving cycles. For example, the average value may be an average value for each operation cycle and may be an average value obtained by integrating two or more operation cycles.

In order to implement simple control logic, for example, the controller may calculate an average value of a plurality of operation cycles corresponding to one month. The controller may calculate a change amount of the calculated average value. For example, the controller may calculate the change amount thereof, based on a first average value of operation data corresponding to the first month, a second average value of operation data corresponding to the next one month, and a third average value of operation data corresponding to one month thereafter. For example, the calculation of the change amount of the average value may be performed over a period of 6 to 12 months.

The controller may recognize the degree of contamination of the heat transfer pipe of the condenser based on the average value or a change amount of the average value. For example, when the number of times that the average value is recognized as equal to or greater than a preset value is equal to or greater than a set number of times, or when the change amount in the average value is recognized as equal to or greater than a preset value, the controller may recognize that the degree of contamination in the heat transfer tube of the condenser has become serious. In this case, the controller may output a notification regarding the cleaning of the heat transfer tube through the display.

A chiller according to embodiments disclosed herein may include a cooling tower configured to store cooling water which exchanges heat with outside air; a condenser including a heat transfer tube through which the cooling water supplied from the cooling tower flows, and into which a refrigerant exchanging heat with the cooling water of the heat transfer tube is introduced; a cooling water outlet temperature sensor provided in a cooling water outlet pipe configured to discharge cooling water from the condenser, and configured to detect a temperature of the discharged cooling water; a condenser pressure sensor provided in the condenser and configured to detect the refrigerant pressure inside the condenser. The chiller may further include a controller configured to collect operation data by calculating a difference value between a value detected by the cooling water outlet temperature sensor and a refrigerant temperature value converted by the condenser pressure sensor to recognize the degree of contamination that foreign matter of the cooling water deposit in the heat transfer tube of the condenser.

The chiller may further include a display configured to output information on the degree of contamination when it is recognized that the information on the difference value deviates from a set value. The chiller may further include a memory configured to update and store the information on the difference value for each operation period, in which the controller may be configured to calculate an average value of difference values for each of a plurality of operation periods stored in the memory.

The controller may be configured to output information on the degree of contamination of the heat transfer tube on the display when the number of times that the average value is recognized as equal to or greater than a preset first set value is recognized as equal to or greater than a set number of times. The controller may be configured to output information on the degree of contamination of the heat transfer tube on the display when recognizing that the amount of change of the average value for each of the plurality of operation periods is equal to or greater than a second set value. The controller, in the process of recognizing the degree of contamination, may be configured to calculate the difference value and stop the process of collecting the operation data when a preset event occurs.

The chiller may further include a condenser level sensor configured to detect the level of the refrigerant stored in the condenser, in which the controller may be configured to stop the collection of the operation data when recognizing that the value detected by the condenser level sensor is equal to or greater than a set or predetermined value. The controller may be configured to stop the collection of the operation data when recognizing that the difference value between the value detected by the cooling water outlet temperature sensor and the refrigerant temperature value converted by the condenser pressure sensor is equal to or less than a set or predetermined value.

The chiller may further include an expansion device configured to decompress the refrigerant condensed in the condenser; an evaporator configured to evaporate the refrigerant depressurized in the expansion device; and a hot gas valve configured to be installed on a connection pipe connecting the condenser and the evaporator and opened to bypass the refrigerant inside the condenser to the evaporator. The controller may be configured to stop the collection of the operation data when recognizing that the hot gas valve is open.

The chiller may further include a cooling water inlet temperature sensor provided in a cooling water inlet pipe for introducing cooling water to the condenser and configured to detect a temperature of the introduced cooling water, in which the controller may be configured to stop the collection of the operation data when recognizing that the difference value between the water inlet temperature and the water outlet temperature of the condenser is equal to or greater than a set value. The chiller may further include a water box provided on both sides of the heat transfer tube of the condenser and providing a flow space of the cooling water, in which the cooling water outlet pipe may be coupled to the water box.

The heat transfer tube of the condenser may include first and second heat transfer tubes partitioned by a separation plate, and a flow hole that guides the refrigerant heat-exchanged in the first heat transfer tube toward the second heat transfer tube may be formed between both ends of the separation plate and the condenser.

A method for controlling a chiller according to embodiments disclosed herein may be provided. The chiller may include a cooling tower configured to store cooling water exchanging heat with outside air, a condenser including a heat transfer tube through which the cooling water supplied from the cooling tower flows, and into which a refrigerant exchanging heat with the cooling water of the heat transfer tube is introduced, a cooling water outlet temperature sensor provided in a cooling water outlet pipe for discharging cooling water from the condenser and configured to detect a temperature of the discharged cooling water, and a condenser pressure sensor provided in the condenser and configured to detect the refrigerant pressure inside of the condenser. The control method may include collecting operation data by calculating, by a controller, a difference value between a value detected by the cooling water outlet temperature sensor and a refrigerant temperature value converted by the condenser pressure sensor. The control method may further include outputting, by the controller, information on the degree of the contamination to a display when it is recognized that the information on the difference value deviates from a set value.

The chiller may further include a memory configured to update and store the information on the difference value for each operation period, and the controller may be configured to calculate an average value of the difference values for each operation period stored in the memory. The controller may be configured to output information on the degree of contamination of the heat transfer tube to the display when the number of times that the average value is recognized as equal to or greater than the first set value is equal to or greater than the set number of times or the amount of change of the average value for each of the plurality of operation periods is equal to or greater than the set number of times.

The controller, in the process of recognizing the degree of the contamination, may be configured to stop the process of calculating the difference value and collecting driving data when a preset or predetermined event occurs. The preset event may include at least one of a first event for recognizing that the value detected by the condenser level sensor is equal to or greater than the set value; a second event for recognizing that the difference value between the value detected by the cooling water outlet temperature sensor and the refrigerant temperature value converted by the condenser pressure sensor is equal to or less than the set value; a third event for recognizing that the hot gas valve, which is opened to bypass the refrigerant in the condenser to the evaporator, is opened; and a fourth event for recognizing that the difference value between the water inlet temperature and the water outlet temperature of the condenser is equal to or greater than the set value.

According to embodiments disclosed herein, as it is possible to determine the degree of contamination of the heat transfer tube and provide a notification regarding whether to clean the heat transfer tube, the chiller may be managed efficiently and the operation performance of the chiller may be maintained well. According to embodiments disclosed herein, as the degree of contamination of the heat transfer tube may be determined by analyzing the operation data of the chiller without a separate component for determining the degree of contamination, economic efficiency may be improved.

According to embodiments disclosed herein, as operation logic capable of recognizing the detection value of an existing sensor for the cycle operation of the chiller and calculating the heat exchanger performance factor by processing the recognized data is provided, simple operation logic may be implemented. As the operation logic for selectively extracting specific data of a plurality of operation data recognized during operation of the chiller that may be used to determine the degree of contamination of the heat transfer tube is provided, the accuracy regarding the determination of the degree of contamination of the heat transfer tube may be improved. In other words, rather than collecting operation data for determining the degree of contamination of the heat transfer tube after the chiller is operated, when an event occurs in which the operation data does not reflect the degree of contamination of the heat transfer tube according to the cycle operation mode, as the operation data is not collected, errors in collected operation data may be prevented.

According to embodiments disclosed herein, considering the foreign matter in the heat transfer tube that accumulates slowly over a long time, it is possible to accumulate and store operation data according to the operation cycle of the chiller, and process the stored operation data to determine the trend of the increase in degree of contamination, so that the continuous and efficient management can be achieved.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A chiller, comprising:

a cooling tower configured to store cooling water that exchanges heat with outside air;

a condenser including at least one heat transfer tube through which the cooling water supplied from the cooling tower flows, and into which a refrigerant that exchanges heat with the cooling water of the at least one heat transfer tube is introduced;

a cooling water outlet temperature sensor provided in a cooling water outlet pipe through which cooling water is discharged from the condenser, and configured to detect a temperature of the discharged cooling water;

a condenser pressure sensor provided in the condenser and configured to detect a pressure of the refrigerant inside of the condenser;

a controller configured to collect operation data by calculating a difference between a temperature detected by the cooling water outlet temperature sensor and a refrigerant temperature, converted from the pressure detected by the condenser pressure sensor, to recognize a degree of contamination of foreign matter of the cooling water deposited in the at least one heat transfer tube of the condenser; and a display configured to output information on the degree of contamination when it is recognized that information regarding the difference deviates from a predetermined amount, wherein the controller, in the process of recognizing the degree of contamination, is configured to stop a process of calculating the difference and collecting the operation data when a predetermined event occurs.

2. The chiller of claim 1, further comprising:

a memory configured to update and store the information on the difference for each operation period, wherein the controller is configured to calculate an average of differences for each of a plurality of operation periods stored in the memory.

3. The chiller of claim 2, wherein the controller is configured to output information on the degree of contamination of the at least one heat transfer tube on the display when a number of times that the average is recognized as equal to or greater than a predetermined value is recognized as equal to or greater than a predetermined number of times.

4. The chiller of claim 2, wherein the controller is configured to output information on the degree of contamination of the at least one heat transfer tube on the display when recognizing that a change amount of the average for each of the plurality of operation periods is equal to or greater than a predetermined amount.

5. The chiller of claim 1, further comprising:

a condenser level sensor configured to detect a level of refrigerant stored in the condenser, wherein the controller is configured to stop collection of the operation data when the level detected by the condenser level sensor is equal to or greater than a predetermined level.

6. The chiller of claim 1, wherein the controller is configured to stop collection of the operation data when the difference between the temperature detected by the cooling water outlet temperature sensor and the refrigerant temperature, converted from the pressure detected by the condenser pressure sensor, is equal to or less than a predetermined amount.

7. The chiller of claim 1, further comprising:

an expansion device configured to decompress the refrigerant condensed in the condenser;

an evaporator configured to evaporate the refrigerant depressurized in the expansion device; and a hot gas valve installed on a connection pipe that connects the condenser and the evaporator and opened to bypass the refrigerant inside of the condenser to the evaporator.

8. The chiller of claim 7, wherein the controller is configured to stop collection of the operation data when the hot gas valve is open.

9. The chiller of claim 1, further comprising:

a cooling water inlet temperature sensor provided in a cooling water inlet pipe that introduces cooling water to the condenser and configured to detect a temperature of the introduced cooling water, wherein the controller is configured to stop collection of the operation data when a difference between the temperature sensed by the cooling water inlet temperature sensor and the temperature sensed by the cooling water outlet temperature sensor is equal to or greater than a predetermined value.

10. The chiller of claim 1, further comprising:

a water box provided at both sides of the at least one heat transfer tube of the condenser and providing a flow space for the cooling water, wherein the cooling water outlet pipe is coupled to the water box.

11. The chiller of claim 10, wherein the water box includes a first water box to which the cooling water outlet pipe is coupled and a second water box provided on a side opposite to the first water box, and wherein a partition plate is provided inside of the first water box to partition a first space for introducing cooling water into the condenser and a second space for discharging heat exchanged cooling water from the condenser.

12. The chiller of claim 1, wherein the at least one heat transfer tube of the condenser includes first and second heat transfer tubes partitioned by a separation plate, and wherein a flow hole to guide refrigerant heat-exchanged in the first heat transfer tube toward the second heat transfer tube is formed between ends of the separation plate and an outer shell of the condenser.

13. The chiller of claim 1, further comprising:

a refrigerant inlet configured to introduce the refrigerant into the condenser; and a guide plate provided inside of the condenser, disposed adjacent to the refrigerant inlet, and against which the refrigerant introducing through the refrigerant inlet collides.

14. A method for controlling a chiller including a cooling tower configured to store cooling water that exchanges heat with outside air, a condenser including at least one heat transfer tube through which the cooling water supplied from the cooling tower flows, and into which a refrigerant that exchanges heat with the cooling water of the at least one heat transfer tube is introduced, a cooling water outlet temperature sensor provided in a cooling water outlet pipe through which cooling water is discharged from the condenser and configured to detect a temperature of the discharged cooling water, and a condenser pressure sensor provided in the condenser and configured to detect a pressure of the refrigerant inside of the condenser, the method comprising:

collecting operation data by calculating, by a controller, a difference between a temperature detected by the cooling water outlet temperature sensor and a refrigerant temperature, converted from the pressure detected by the condenser pressure sensor; and outputting, by the controller, information on a degree of contamination to a display when it is recognized that the information on the difference deviates from a first predetermined amount, wherein the controller, in the process of recognizing the degree of the contamination, is configured to stop a process of calculating the difference and collecting drive data when a predetermined event occurs.

15. The method for controlling the chiller of claim 14, wherein the chiller further includes a memory configured to update and store the information on the difference for each operation period, and wherein the controller is configured to calculate an average of differences for a plurality of operation periods stored in the memory.

16. The method for controlling the chiller of claim 15, wherein the controller is configured to output information on the degree of contamination of the at least one heat transfer tube on the display when a number of times that the average is recognized as equal to or greater than the first predetermined amount is equal to or greater than a predetermined number of times or a change amount of the average for each of the plurality of operation periods is equal to or greater than a second predetermined amount.

17. The method for controlling the chiller of claim 14, wherein the predetermined event includes at least one of:

a first event in which the level detected by a condenser level sensor is equal to or greater than a predetermined level;

a second event in which a difference between the temperature detected by the cooling water outlet temperature sensor and a refrigerant temperature, converted from the pressure detected by the condenser pressure sensor, is equal to or less than the predetermined value;

a third event in which a hot gas valve, which is opened to bypass refrigerant in the condenser to the evaporator, is opened; or a fourth event in which a difference between a temperature detected by a cooling water inlet temperature and a temperature detected by a cooling water outlet temperature of the condenser is equal to or greater than a second predetermined amount.

18. A chiller, comprising:

a cooling tower configured to store cooling water that exchanges heat with outside air;

a condenser including at least one heat transfer tube through which the cooling water supplied from the cooling tower flows, and into which a refrigerant that exchanges heat with the cooling water of the at least one heat transfer tube is introduced;

a cooling water outlet temperature sensor provided in a cooling water outlet pipe through which cooling water is discharged from the condenser, and configured to detect a temperature of the discharged cooling water;

a condenser pressure sensor provided in the condenser and configured to detect a pressure of the refrigerant inside of the condenser; and a controller configured to collect operation data by calculating a difference between a temperature detected by the cooling water outlet temperature sensor and a refrigerant temperature, converted from the pressure detected by the condenser pressure sensor, to recognize a degree of contamination of foreign matter of the cooling water deposited in the at least one heat transfer tube of the condenser, wherein the controller, in the process of recognizing the degree of contamination, is configured to stop a process of calculating the difference and collecting the operation data when a predetermined event occurs.

19. The chiller of claim 18, wherein the predetermined event includes at least one of:

a first event in which the level detected by a condenser level sensor is equal to or greater than a predetermined level;

a second event in which a difference between the temperature detected by the cooling water outlet temperature sensor and a refrigerant temperature, converted from the pressure detected by the condenser pressure sensor, is equal to or less than the predetermined value;

a third event in which a hot gas valve, which is opened to bypass refrigerant in the condenser to the evaporator, is opened; or a fourth event in which a difference between a temperature detected by a cooling water inlet temperature and a temperature detected by a cooling water outlet temperature of the condenser is equal to or greater than a second predetermined amount.

* * * * *